US008597862B2

(12) United States Patent
Daisuke et al.

(10) Patent No.: US 8,597,862 B2
(45) Date of Patent: Dec. 3, 2013

(54) POSITIVE CHARGING SINGLE-LAYER ELECTROPHOTOGRAPHIC PHOTOCONDUCTOR, IMAGE-FORMING APPARATUS AND METHOD FOR FORMING AN IMAGE

(75) Inventors: Kuboshima Daisuke, Osaka (JP); Shishido Makoto, Osaka (JP); Yamamoto Yohei, Osaka (JP); Shimizu Tomofumi, Osaka (JP); Miyamoto Eiichi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 157 days.

(21) Appl. No.: 13/151,566

(22) Filed: Jun. 2, 2011

(65) Prior Publication Data

US 2011/0300476 A1 Dec. 8, 2011

(30) Foreign Application Priority Data

Jun. 4, 2010 (JP) ..... 2010-129454

(51) Int. Cl.
*G03G 5/06* (2006.01)

(52) U.S. Cl.
USPC ..... 430/56; 430/123.42; 399/159

(58) Field of Classification Search
USPC ..... 430/56, 123.42; 399/159
See application file for complete search history.

(56) References Cited

U.S. PATENT DOCUMENTS 4,226,928 A * 10/1980 Nakazawa et al. ..... 430/58.25
4,469,769 A * 9/1984 Nakazawa et al. ..... 430/78
4,565,762 A * 1/1986 Kato ..... 118/260
4,822,705 A * 4/1989 Fukagai et al. ..... 430/60
5,008,706 A * 4/1991 Ohmori et al. ..... 399/174
5,166,019 A * 11/1992 Ueda et al. ..... 430/58.85
5,330,866 A * 7/1994 Ueda ..... 430/58.35
5,363,176 A * 11/1994 Ishihara et al. ..... 399/176
5,492,786 A * 2/1996 Sugimura et al. ..... 430/58.3
5,763,126 A * 6/1998 Miyauchi et al. ..... 430/58.2
5,994,012 A * 11/1999 Watanabe et al. ..... 430/58.25
6,465,648 B1 * 10/2002 Tadokoro et al. ..... 544/225
6,485,873 B1 * 11/2002 Ohkura et al. ..... 430/83
2002/0051921 A1 * 5/2002 Morita et al. ..... 430/78
2004/0096761 A1 * 5/2004 Lin et al. ..... 430/58.15
2005/0106483 A1 * 5/2005 Shoshi et al. ..... 430/58.7
2005/0232657 A1 * 10/2005 Fujii et al. ..... 399/159
2006/0204874 A1 * 9/2006 Ohkura et al. ..... 430/70
2007/0009819 A1 * 1/2007 Sekine et al. ..... 430/58.15
2009/0317733 A1 * 12/2009 Okura et al. ..... 430/56

FOREIGN PATENT DOCUMENTS

JP 57005050 A * 1/1982
JP 2002-174919 6/2002
JP 2009-162916 7/2009

OTHER PUBLICATIONS

English-language Translation of JP57005050 (Kojima) reference cited in PTO-892 accompanying Office Action mailed Jan. 7, 2013.

* cited by examiner

*Primary Examiner* — Christopher Rodee
(74) *Attorney, Agent, or Firm* — Frommer Lawrence & Haug LLP

(57) ABSTRACT

A positive charging single-layer electrophotographic photoconductor configured to serve as an image-bearing member for use in an image-forming apparatus includes a photosensitive layer on a conductive base, including a charge-generating material, a hole-transport material, an electron-transport material, and a binder resin, in which the photosensitive layer has a polysiloxane oil, with the amount of the polysiloxane oil being in the range of about 0.005% by mass to about 0.021% by mass with respect to the total mass of materials.

13 Claims, 3 Drawing Sheets

POSITIVE CHARGING SINGLE-LAYER ELECTROPHOTOGRAPHIC PHOTOCONDUCTOR, IMAGE-FORMING APPARATUS AND METHOD FOR FORMING AN IMAGE

INCORPORATION BY REFERENCE

This application is based upon and claims the benefit of priority from the corresponding Japanese Patent Application No. 2010-129454, filed Jun. 4, 2010, the entire contents of which are incorporated herein by reference.

FIELD

The present disclosure relates to a positive charging single-layer electrophotographic photoconductor, an image-forming apparatus including the positive charging single-layer electrophotographic photoconductor and a method for forming an image.

BACKGROUND

Electrophotographic photoconductors for use in image-forming apparatuses using electrophotographic methods include inorganic photoconductors including photosensitive layers composed of inorganic materials, such as selenium; and organic photoconductors including photosensitive layers mainly composed of organic materials, such as binder resins, charge-generating materials, and charge transport materials. Among these photoconductors, organic photoconductors are widely used because they are easily produced, materials for photosensitive layers can be selected from a wide variety of materials, and high design flexibility is provided, as compared with inorganic photoconductors.

Examples of organic photoconductors include single-layer organic photoconductors each provided with a photosensitive layer that contains a charge-generating material and a charge transport material in the same layer. It is known that single-layer organic photoconductors have simple layer structures, are easily produced, and suppress the occurrence of coating defects, as compared with multilayer organic photoconductors each including a charge-generating layer containing a charge-generating material and a charge transport layer containing a charge transport material stacked on a conductive base. Because of these advantages, single-layer organic photoconductors are increasingly being used.

Furthermore, it is known that the use of contact charging methods in positive polarity serving as methods for charging electrophotographic photoconductors of image-forming apparatuses significantly reduces the amount of oxidizing gas generation, such as ozone, formed during charging. So, a positive charging method in positive polarity is often employed as a method for charging an electrophotographic photoconductor of an image-forming apparatus in view of adverse effects on the lifetime of photoconductors and office environments by the emission of the oxidizing gas, such as ozone. Positive charging single-layer electrophotographic photoconductors are increasingly being used from this point of view.

However, photosensitive layers of organic photoconductors are liable to wear because they are composed of soft organic materials. It is known that, in particular, surface states are easily changed due to wear during the initial use of organic photoconductors, thus causing a rapid reduction in surface potential with wear, so that image defects are liable to occur.

Additionally, in such contact charging methods, photosensitive layers wear significantly, compared with non-contact charging methods. In the case where positive charging single-layer electrophotographic photoconductors are used in contact charging methods, surface potentials are reduced during initial use, so that sufficient characteristics for use in an image-forming apparatus are not obtained.

SUMMARY

According to an aspect of some embodiments of the present disclosure, a positive charging single-layer electrophotographic photoconductor configured to serve as an image-bearing member for use in an image-forming apparatus includes a photosensitive layer on a conductive base, including a charge-generating material, a hole-transport material, an electron-transport material, and a binder resin, in which the photosensitive layer comprises a polysiloxane oil, in an amount of at least about 0.005% by mass and not greater than about 0.021% by mass with respect to the total mass of materials. In various embodiments, the image-forming apparatus may include a charging portion configured to apply a direct voltage by a contact charging method to the image-bearing member.

According to some aspects of the present disclosure, an image-forming apparatus includes an image-bearing member, a charging portion configured to charge a surface of the image-bearing member, an exposure portion configured to expose the charged image-bearing member to form an electrostatic latent image on the surface of the image-bearing member, a developing portion configured to develop the electrostatic latent image to form a toner image, and a transfer portion configured to transfer the toner image from the image-bearing member to an object, in which the image-bearing member is the positive charging single-layer electrophotographic photoconductor described above.

According to some aspects of the present disclosure, a method for forming an image includes charging a surface of the image-bearing member by the contact charging method, exposing the charged image-bearing member to form an electrostatic latent image on the surface of the image-bearing member, developing the electrostatic latent image to form a toner image, and transferring the toner image from the image-bearing member to an object, in which the image-bearing member is the positive charging single-layer electrophotographic photoconductor described above.

The above and other objects, features, and advantages of various embodiments of the present disclosure will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include". The phrase "an embodiment" as used herein does not necessarily refer to the same embodiment, though it may. In addition, the meaning of "a," "an," and "the" include plural references; thus, for example, "an embodiment" is not limited to a single embodiment but refers to one or more embodiments. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise.

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED-DESCRIPTION

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the various embodiments of the disclosure without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

Some embodiments relate to a positive charging single-layer electrophotographic photoconductor configured to serve as an image-bearing member for use in an image-forming apparatus that includes a charging portion configured to apply a direct voltage by a contact charging method, the positive charging single-layer electrophotographic photoconductor including a photosensitive layer on a conductive base, with the photosensitive layer including a charge-generating material, a hole-transport material, an electron-transport material, and a binder resin, in which the photosensitive layer has a polysiloxane oil, amount of polysiloxane oil ranging about 0.005% by mass to about 0.021% by mass with respect to the total mass of materials of the photosensitive layer. As indicated in the background section, and as understood by those skilled in the art, a single-layer electrophotographic photoconductor as used herein refers to an electrophotographic photoconductor in which the charge-generating and charge-transport functions are provided in the same layer, although the single-layer electrophotographic photoconductor may comprise two or more layers.

Figure 1A:
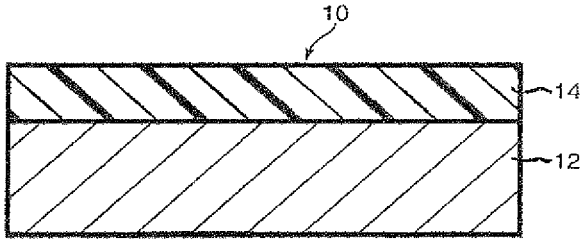
FIGS. 1A to 1C are schematic diagrams each illustrating the structure of a positive charging single-layer electrophotographic photoconductor according to an embodiment of the present disclosure.
Figure 1B:
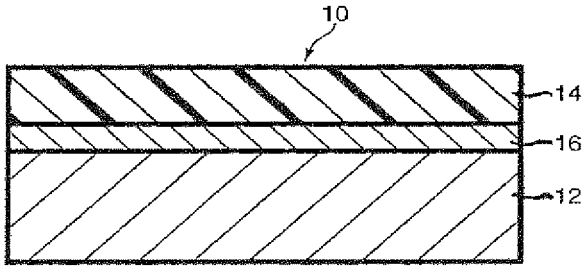
Figure 1C:
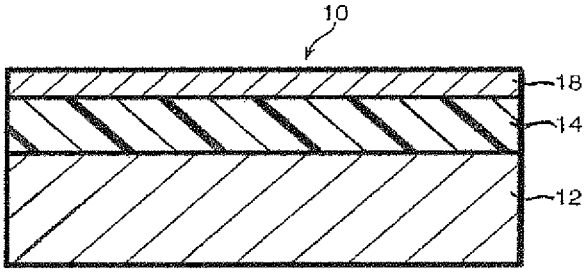

Referring to FIGS. 1A to 1C, a positive charging single-layer electrophotographic photoconductor 10 according to an embodiment of the present disclosure includes a conductive base 12 and a photosensitive layer 14 arranged on the conductive base 12, the photosensitive layer 14 having a single-layer structure and comprising a charge-generating material, a hole-transport material and an electron-transport material as a charge transport material, and a binder resin. The positive charging single-layer electrophotographic photoconductor 10 comprising the conductive base 12 and the photosensitive layer 14 is not particularly limited, and may comprise one or more additional layers.

Specifically, for example, as illustrated in FIG. 1A, in some embodiments the photosensitive layer 14 may be arranged directly on the conductive base 12. As illustrated in FIG. 1B, some embodiments may include an intermediate layer 16 arranged between the conductive base 12 and the photosensitive layer 14. As illustrated in FIGS. 1A and 1B, the photosensitive layer 14 may serve as an outermost layer. As illustrated in FIG. 1C, in some embodiments a protective layer 18 may be arranged on the photosensitive layer 14. These illustrative embodiments are not exclusive; for example, embodiments may comprise one or more layers disposed between photosensitive layer 14 and conductive base 12 and may alternatively or additionally comprise one or more layers disposed on or above the upper surface of photosensitive layer 14 (i.e., this "upper surface," with reference to the views in FIGS. 1A-1C; being the surface of photosensitive layer 14 that is farthest from conductive base 12).

Illustrative embodiments of the conductive base and the photosensitive layer are described below.

The conductive base according to an embodiment of the present disclosure is not particularly limited as long as it can be used as a conductive base of the positive charging single-layer electrophotographic photoconductor.

A conductive base is a component having at least a surface comprising an electrically conductive material. For example, a component comprising essentially entirely of an electrically conductive material may be used as the conductive base. Alternatively, a component comprising, for example, a plastic or other insulating or dielectric material, and having a surface covered with an electrically conductive material may be used as the conductive base.

Non-limiting examples of the conductive material include aluminum, iron, copper, tin, platinum, silver, vanadium, molybdenum, chromium, cadmium, titanium, nickel, palladium, indium, stainless steel, and brass.

These, and other, conductive materials may be used separately or in combination as, for example, an alloy of two or more.

Among these materials, aluminum or an aluminum alloy may be preferable or particularly well-suited for implementing some embodiments of the conductive base. Such embodiments may provide a positive charging single-layer electrophotographic photoconductor that may be capable of forming a more preferred image in some implementations.

A possible reason for preferred images possibly being provided by some implementations of a positive charging single-layer electrophotographic photoconductor employing an aluminum or aluminum alloy conductive base is that, in some implementations, using such a conductive base provides for charges being satisfactorily transferred from the photosensitive layer to the conductive base.

The shape of the conductive base may be appropriately selected, depending on the structure of an image-forming apparatus used. Examples of the shape of the base that can be used include sheets and drums.

In accordance with some embodiments, the photosensitive layer included in the positive charging single-layer electrophotographic photoconductor is not particularly limited as long as the photosensitive layer has a single-layer structure, contains a charge-generating material, a hole-transport material, an electron-transport material, and a binder resin, and has a polysiloxane oil in an amount ranging from about 0.005% by mass to about 0.021% by mass with respect to the total mass of the materials.

In some embodiments, in the case of an image-forming apparatus including a charging portion configured to apply a direct voltage by a contact charging method, the presence of the polysiloxane oil in the photosensitive layer in an amount within the range described above suppresses a reduction in surface potential during initial use when the positive charging single-layer electrophotographic photoconductor is used. In this respect, it is understood that the above specified approximate limits for the range of polysiloxane oil reflect, for example, not only measurement error and/or nominal variations, but also deviations from the specified values that do not result in a substantially degraded characteristic with respect to suppressing surface potential reduction. In various embodiments, however, such surface-potential-reduction suppression characteristics are associated with having polysiloxane oil in an amount ranging from about 0.005% by mass to about 0.021% by mass with respect to the total mass of the materials in the photosensitive layer, these values nonetheless reflecting measurement error and/or nominal variations.

So, the selection of the materials for the photosensitive layer in the positive charging single-layer electrophotographic photoconductor is not significantly limited. Furthermore, when the polysiloxane amount of the photosensitive layer falls within the above range, a defect in the photosensitive layer is less likely to occur.

The polysiloxane oil, the charge-generating material, the hole-transport material, the electron-transport material, the binder resin, and additives, which are components included in the photosensitive layer, will be described below with respect to various illustrative embodiments. Furthermore, a method for producing a positive charging single-layer electrophotographic photoconductor will be described below in accordance with some embodiments.

In view of the present disclosure, it will be understood that various polysiloxane oils may be used, without limitation, in the positive charging single-layer electrophotographic photoconductor to provide the desired characteristics. Some examples of the polysiloxane oil include organopolysiloxane represented by general formula (1):

general formula (1)

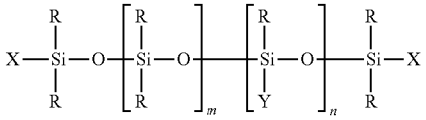

(wherein R's may be the same or different, and each represent an alkyl group having 1 to 6 carbon atoms or a phenyl group; X's may be the same or different, and each represent a group selected from the group consisting of alkyl groups each having 1 to 6 carbon atoms, a phenyl group, modified reactive groups, and modified nonreactive groups; Y represents a modified reactive group or a modified nonreactive group, and when a plurality of Y's are present, Y's may be the same or different; m represents an integer of 1 or more; and n represents an integer of 0 or more).

When each X or Y represents a modified reactive group or a modified nonreactive group contained in the polysiloxane oil represented by general formula (1), specific illustrative examples thereof include those described below.

Examples of the modified reactive group include:

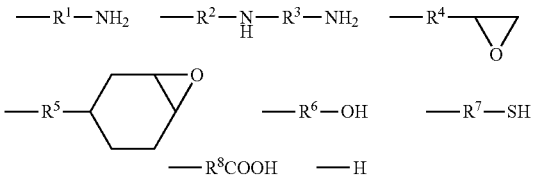

(wherein $R^1$ to $R^8$ each represent a single bond or an alkylene group having 1 to 6 carbon atoms).

Examples of the modified nonreactive group include:

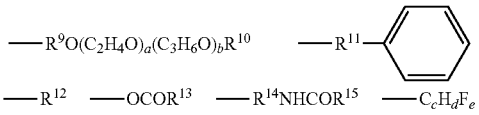

(wherein $R^9$ and $R^{14}$ each represent a single bond or an alkylene group having 1 to 6 carbon atoms; $R^{10}$ represents an alkyl group having 1 to 6 carbon atoms; $R^{11}$ represents an alkylene group having 1 to 6 carbon atoms; $R^{12}$, $R^{13}$, and $R^{15}$ each represent an alkyl group having 7 to 20 carbon atoms; a and b each represent an integer of 0 or more, and the sum of a and b is 1 or more; c represents an integer of 1 to 6, d represents an integer of 0 or more, e represents an integer of 1 or more, and the relationship d+e=2c+1 is satisfied).

The polysiloxane oil used in an embodiment of the present disclosure may contain the following branch chain in a molecular chain:

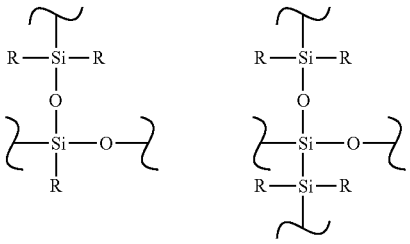

The viscosity-average molecular weight of the polysiloxane oil used in an embodiment of the present disclosure is not particularly limited provided the desired characteristics of the single-layer electrophotographic photoconductor are achieved. In some embodiments, the polysiloxane oil has a viscosity-average molecular weight of 1,000 to 10,000. The viscosity-average molecular weight (M) can be calculated from, for example, the A. J. Barry formula ($\log(\eta)=1.00+0.0123M^{0.5}$) described in J. Appl. Phys. 17, 1020 (1946) using the viscosity of the polysiloxane oil.

In some embodiments, dimethylpolysiloxane oil is particularly well-suited as the polysiloxane oil.

The charge-generating material is not particularly limited as long as it can be used as a charge-generating material for the positive charging single-layer electrophotographic photoconductor. Specific examples thereof that may be used in various embodiments include X-form metal-free phthalocyanine (x-H2Pc) represented by formula (2) described below, Y-form oxotitanylphthalocyanine (Y—TiOPc), perylene pigments, bisazo pigments, dithioketopyrrolopyrrole pigments, metal-free naphthalocyanine pigments, metal naphthalocyanine pigments, squaraine pigments, trisazo pigments, indigo pigments, azulenium pigments, cyanine pigments, powdered inorganic photoconductive materials, such as selenium, selenium-tellurium, selenium-arsenic, cadmium sulfide, and amorphous silicon, pyrylium salts, anthanthrone pigments, triphenylmethane pigments, indanthrene pigments, toluidine pigments, pyrazoline pigments, and quinacridone pigments:

formula (2)

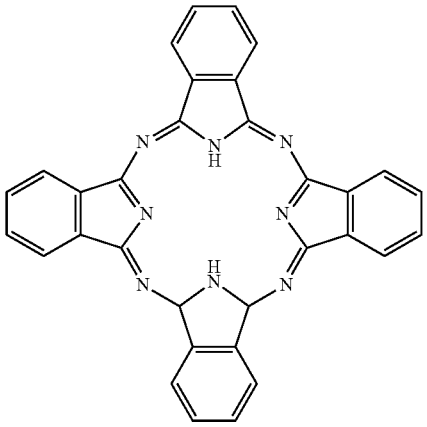

These charge-generating materials may be used separately or in combination of two or more so as to have an absorption wavelength in a desired region. Among these charge-generating materials, in particular, for digital optical image-forming apparatuses, such as laser beam printers and facsimiles, provided with light sources, such as semiconductor lasers, photoconductors sensitive in the wavelength range of 700 nm or more are required. So, for example, phthalocyanine pigments, such as metal-free phthalocyanine and oxotitanylphthalocyanine, are preferably used in some embodiments.

Note that various crystal forms of the phthalocyanine pigments may be used without limitation. Furthermore, for analog optical image-forming apparatuses, such as electrostatic copiers, provided with white light sources, such as halogen lamps, photoconductors sensitive in the visible range are required. So, for example, perylene pigments and bisazo pigments are preferably used in some such implementations.

The hole-transport material is not particularly limited as long as it can be used as a hole-transport material contained in the photosensitive layer of the positive charging single-layer electrophotographic photoconductor.

Specific examples of the hole-transport material that may be used in some embodiments include benzidine derivatives; oxadiazole compounds, such as 2,5-di-(4-methylaminophenyl)-1,3,4-oxadiazole; styryl compounds, such as 9-(4-diethylaminostyryl)anthracene; carbazole compounds, such as polyvinylcarbazole; organic polysilane compounds; pyrazoline compounds, such as 1-phenyl-3-(p-dimethylaminophenyl)pyrazoline; hydrazone compounds; triphenylamine compounds; nitrogen-containing cyclic compounds, such as indole compounds, oxazole compounds, isoxazole compounds, thiazole compounds, and triazole compounds; and fused polycyclic compounds. Among these hole-transport materials, triphenylamine compounds, each having one or more triphenylamine skeletons in a molecule, may be preferred for some embodiments.

These hole-transport materials may be used separately or in combination of two or more.

The electron-transport material is not particularly limited as long as it can be used as an electron-transport material contained in the photosensitive layer of the positive charging single-layer electrophotographic photoconductor.

Specific examples thereof that may be used in some embodiments include quinone derivatives, such as naphthoquinone derivatives, diphenoquinone derivatives, anthraquinone derivatives, azoquinone derivatives, nitroanthraquinone derivatives, and dinitroanthraquinone derivatives; and malononitrile derivatives, thiopyran derivatives, trinitrothioxanthone derivatives, 3,4,5,7-tetranitro-9-fluorenone derivatives, dinitroanthracene derivatives, dinitroacridine derivatives, tetracyanoethylene, 2,4,8-trinitrothioxanthone, dinitrobenzene, dinitroanthracene, dinitroacridine, succinic anhydride, maleic anhydride, and dibromomaleic anhydride.

The electron-transport materials may be used separately or in combination of two or more.

The binder resin is not particularly limited as long as it can be used as a binder resin contained in the photosensitive layer of the positive charging single-layer electrophotographic photoconductor.

Specific examples of a resin that can be suitably used as the binder resin in some embodiments include, for example thermoplastic resins, such as polycarbonate resins, styrene resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, polyester resins, alkyd resins, polyurethane resins, polyarylate resins, polysulfone resins, diallyl phthalate resins, ketone resins, and polyether resins; thermosetting resins, such as silicone resins, epoxy resins, phenol resins, urea resins, melamine resins, and other crosslinkable thermosetting resins; and photocurable resins, such as epoxy acrylate resins and urethane-acrylate copolymer resins. These resins may be used separately or in combinations of two or more.

Among these resins, polycarbonate resins, such as bisphenol Z-type polycarbonate resins, bisphenol ZC-type polycarbonate resins, bisphenol C-type polycarbonate resins, and bisphenol A-type polycarbonate resins may be preferred for some embodiments because the photosensitive layer comprising a polycarbonate resin typically has, in various implementations, excellent balance among processability, mechanical properties, optical properties, and wear resistance.

The photosensitive layer of the positive charging single-layer electrophotographic photoconductor may contain various additives to the extent that electrophotographic characteristics are not adversely affected, in addition to the polysiloxane oil, the charge-generating material, the hole-transport material, the electron-transport material, and the binder resin. Examples of additives that can be added to the photosensitive layer according to some embodiments include antidegradants, such as antioxidants, radical scavengers, singlet quenchers and ultraviolet absorber, softeners, plasticizers, surface modifiers, extenders, thickeners, dispersion stabilizers, wax, acceptors, donors, surfactants, and leveling agents.

In accordance with some embodiments, a method for producing the positive charging single-layer electrophotographic photoconductor is not particularly limited as long as the desired characteristics of the single-layer electrophotographic photoconductor are achieved. An illustrative method, which in some cases may be preferred, for producing the positive charging single-layer electrophotographic photoconductor is a method including applying a coating liquid for the photosensitive layer onto the conductive base to form the photosensitive layer. Specifically, in some embodiments, a coating liquid in which the polysiloxane oil, the charge-generating material, the hole-transport material, the electron-transport material, the binder resin, and, optionally, various additives are dissolved or dispersed in a solvent, is applied onto the conductive base and dried to produce the photoconductor.

An application method is not particularly limited. Examples thereof include methods using spin coaters, applicators, spray coaters, bar coaters, dip coaters, and doctor blades. An example of a method for drying the coating film formed on the conductive base is a method in which hot-air drying is performed at 80° C. to 150° C. for 15 minutes to 120 minutes.

In the positive charging single-layer electrophotographic photoconductor according to some embodiments, the photosensitive layer has a polysiloxane oil, amount of polysiloxane oil ranging from about 0.005% by mass to about 0.021% by mass and preferably from 0.005% by mass to 0.016% by mass with respect to the total mass of the materials. In some embodiments, in the case where a direct voltage is applied by a contact charging method, the presence of the polysiloxane oil in the photosensitive layer in an amount within the range described above stabilizes the amount of the charge of the positive charging single-layer electrophotographic photoconductor during initial use without causing a defect on a surface of the positive charging single-layer electrophotographic photoconductor.

In the positive charging single-layer electrophotographic photoconductor, proportions of the charge-generating material, the hole-transport material, the electron-transport material, and the binder resin are appropriately determined and are not particularly limited. While these proportions are not particularly limited, the following nevertheless provides illustrative ranges that may be implemented in some embodiments.

Specifically, for example, in some embodiments, the proportion of the charge-generating material is preferably in the range of 0.1 parts by mass to 50 parts by mass and more preferably 0.5 parts by mass to 30 parts by mass with respect to 100 parts by mass of the binder resin.

Additionally, in some embodiments the proportion of the electron-transport material is preferably in the range of 5 parts by mass to 100 parts by mass and more preferably 10 parts by mass to 80 parts by mass with respect to 100 parts by mass of the binder resin.

Further, in various embodiments the proportion of the hole-transport material is preferably in the range of 5 parts by mass to 500 parts by mass and more preferably 25 parts by mass to 200 parts by mass with respect to 100 parts by mass of the binder resin.

In some embodiments, the total amount of the hole-transport material and the electron-transport material, i.e., the amount of the charge transport material, is preferably in the range of 20 parts by mass to 500 parts by mass and more preferably 30 parts by mass to 200 parts by mass with respect to 100 parts by mass of the binder resin.

The thickness of the photosensitive layer of the positive charging single-layer electrophotographic photoconductor is not particularly limited as long as the photosensitive layer functions sufficiently as a photosensitive layer.

Specifically, by way of example, in some embodiments the photosensitive layer preferably may have a thickness of 5 μm to 100 μm and more preferably 10 μm to 50 μm.

The solvent contained in the coating liquid for the photosensitive layer is not particularly limited as long as the materials constituting the photosensitive layer can be dissolved or dispersed therein. Specific examples thereof that may be used in some embodiments include alcohols, such as methanol, ethanol, isopropanol, and butanol; aliphatic hydrocarbons, such as n-hexane, octane, and cyclohexane; aromatic hydrocarbons, such as benzene, toluene, and xylene; halogenated hydrocarbons, such as dichloromethane, dichloroethane, carbon tetrachloride, and chlorobenzene; ethers, such as dimethyl ether, diethyl ether, tetrahydrofuran, ethylene glycol dimethyl ether, and diethylene glycol dimethyl ether; ketones, such as acetone, methyl ethyl ketone, methyl isobutyl ketone, and cyclohexanone; esters, such as ethyl acetate and methyl acetate; and aprotic polar organic solvents, such as dimethylformaldehyde, dimethylformamide, and dimethyl sulfoxide. These solvents may be used separately or in combination of two or more.

The positive charging single-layer electrophotographic photoconductor may be used as an image-bearing member for use in an image-forming apparatus that includes a charging portion configured, in some embodiments, to apply a direct voltage by a contact charging method as described below (though it may be used in an image forming apparatus that employs non-contact charging). In such implementations, the positive charging single-layer electrophotographic photoconductor according to some embodiments results in the stabilization of the surface potential of the positive charging single-layer electrophotographic photoconductor during initial use even under conditions in which the charging portion configured to apply a direct voltage by the contact charging method is used, i.e., the surface potential is less likely to be stabilized. Thereby, it is possible to provide the image-forming apparatus that suppresses the occurrence of image defects.

Some embodiments of the present disclosure also relate to an image-forming apparatus that includes an image-bearing member, a charging portion configured to apply a direct voltage by a contact charging method to charge a surface of the image-bearing member, an exposure portion configured to expose the charged image-bearing member to form an electrostatic latent image on the surface of the image-bearing member, a developing portion configured to develop the electrostatic latent image to form a toner image, and a transfer portion configured to transfer the toner image from the image-bearing member to an object, such as a paper, in which a positive charging single-layer electrophotographic photoconductor according to the foregoing discussed embodiments is used as the image-bearing member.

The image-forming apparatus according to such embodiments of the present disclosure can be used for any of monochrome-image-forming apparatuses and color-image-forming apparatuses. Here, by way of example, an embodiment of a tandem-type color image-forming apparatus using a plurality of color toners will be described.

The image-forming apparatus including the positive charging single-layer electrophotographic photoconductor according to this embodiment includes a plurality of image-bearing members which are juxtaposed to each other in a predetermined direction and which are configured to form toner images using toners of different colors; and a plurality of developing portions including developing rollers which face the respective image-bearing members and which are configured to transfer the toners attached on surfaces thereof and feed the toners onto surfaces of the respective image-bearing members, in which a positive charging single-layer electrophotographic photoconductor according to the foregoing discussed embodiments is used as each of the image-bearing members.

Figure 2:
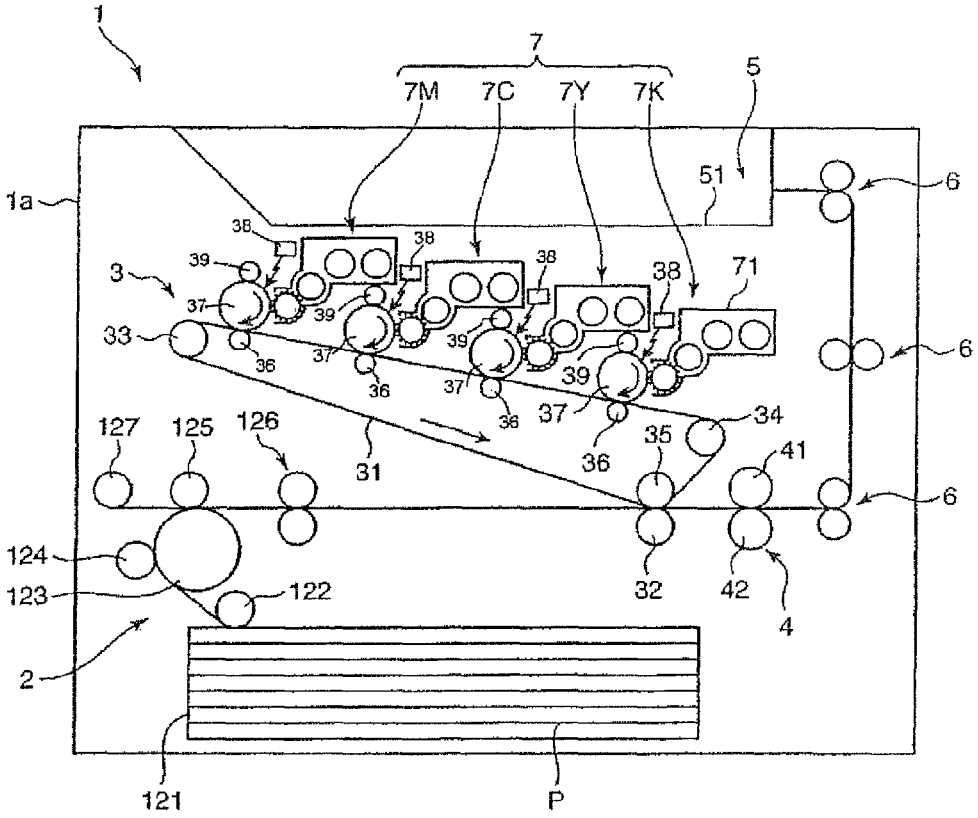
FIG. 2 is a schematic diagram illustrating the structure of an image-forming apparatus including a positive charging single-layer electrophotographic photoconductor according to an embodiment of the present disclosure.

FIG. 2 is a schematic diagram illustrating an embodiment of a tandem-type image-forming apparatus including a positive charging single-layer electrophotographic photoconductor according to the foregoing discussed embodiments of the present disclosure.

Here, an image-forming apparatus will be described by taking a color printer 1 as an example.

As illustrated in FIG. 2, the color printer 1 includes a box-shaped main body 1*a*. The box-shaped main body 1*a* is provided with a paper feed portion 2 configured to feed paper P, an image-forming portion 3 configured to transfer a toner image on the paper P on the basis of, for example, image data while the paper P fed from the paper feed portion 2 is being transferred, and a fusing portion 4 configured to perform fusing treatment in which the unfused toner image transferred on the paper P in the image-forming portion 3 is fused on the paper P. Furthermore, a paper-ejecting portion 5 to which the paper P subjected to the fusing treatment in the fusing portion 4 is ejected is arranged on the upper surface of the main body 1*a*.

The paper feed portion 2 includes a paper feed cassette 121, a pick-up roller 122, paper feed rollers 123, 124, and 125, and a registration roller 126.

The paper feed cassette 121 configured to store different sized sheets of paper P is detachably arranged in the main body 1*a*. The pickup roller 122 is arranged at the upper left of the paper feed cassette 121 as illustrated in FIG. 2 and picks up the paper P, sheet by sheet, stored in the paper feed cassette 121.

The paper feed rollers 123, 124, and 125 feed the paper P picked up by the pickup roller 122 to a paper conveying path. The registration roller 126 temporarily holds the paper P fed by the paper feed rollers 123, 124, and 125 to the paper conveying path, and then feeds the paper P to the image-forming portion 3 at a predetermined time.

The paper feed portion 2 further includes a manual feed tray (not shown) attached to the left side of the main body 1*a* illustrated in FIG. 2; and a pickup roller 127. The pickup roller 127 picks up the paper P placed in the manual feed tray.

The paper P picked up by the pickup roller 127 is fed by the paper feed rollers 123 and 125 to the paper conveying path and then fed by the registration roller 126 to the image-forming portion 3 at a predetermined time.

The image-forming portion 3 includes an image-forming unit 7, an intermediate transfer belt 31 in which a toner image formed on the basis of image data transmitted from, for example, a computer is primarily transferred by the image-forming unit 7 onto a surface (contact surface), and a secondary transfer roller 32 configured to secondarily transfer the toner image formed on the intermediate transfer belt 31 onto the paper P fed from the paper feed cassette 121.

The image-forming unit 7 includes a unit 7K for black toner development, a unit 7Y for yellow toner development, a unit 7C for cyan toner development, and a unit 7M for magenta toner development sequentially arranged from the upstream side (right side in FIG. 2) to the downstream side.

A positive charging single-layer electrophotographic photoconductor 37 (hereinafter, referred to as a "photoconductor 37") configured to serve as an image-bearing member is arranged at the center of each of the units 7K, 7Y, 7C, and 7M so as to be rotated in the direction indicated by an arrow (in a clockwise direction).

A charging portion 39, an exposure portion 38, a developing portion 71, a cleaning portion (not shown), a charge eliminator (not shown) as a charge eliminating portion, and so forth are arranged around each of the photoconductors 37 from the upstream side along the rotational direction. As the photoconductor 37, a positive charging single-layer electrophotographic photoconductor according to the hereinabove described embodiments is used.

The charging portion 39 uniformly charges the circumferential face of the photoconductor 37 that rotates in the direction indicated by the arrow. A specific example of the charging portion 39 is a portion in which a charging roller charges the circumferential face (surface) of the photoconductor 37 while the portion is in contact with the photoconductor 37. The charging portion 39 including the charging roller is preferably used in various embodiments.

An example of the charging roller is a roller that rotates in response to the rotation of the photoconductor 37 while the roller is in contact with the photoconductor 37. A roller having at least a surface portion composed of a resin is exemplified.

More specifically, a roller is exemplified which includes a mandrel rotatably supported, a resin layer arranged on the mandrel, and a voltage-applying portion configured to apply a voltage to the mandrel. The charging portion including the charging roller charges the surface of the photoconductor 37 in contact with the resin layer by the application of a voltage to the mandrel using the voltage-applying portion.

In various embodiments such as that presently described, a voltage applied by the voltage-applying portion to the charging roller is only a direct voltage. As described above, in the case where only a direct voltage is applied to the charging roller, the wear amount of the photosensitive layer tends to be small, compared with the case where an alternating voltage or a superimposed voltage in which an alternating voltage is superimposed on a direct voltage.

So, in accordance with various embodiments, the positive charging single-layer electrophotographic photoconductor provides for the suppression of the change of the surface state of the photosensitive layer of the positive charging single-layer electrophotographic photoconductor due to wear during initial use, and thus results in the stabilization of the surface potential of the photoconductor 37. In various implementations, the direct voltage applied to the positive charging single-layer electrophotographic photoconductor may preferably be in the range of 1000 V to 2000 V, more preferably 1200 V to 1800 V, and particularly preferably 1400 V to 1600 V.

In the case where an image-forming apparatus includes a charging portion provided with a charging roller configured to apply a direct voltage, and a positive charging single-layer electrophotographic photoconductor configured to serve as an image-bearing member, the surface potential of the positive charging single-layer electrophotographic photoconductor 37 during initial use is less likely to be stable because the charging efficiency of the contact charging method is lower than that of a non-contact charging method. However, the use of the positive charging single-layer electrophotographic photoconductor according to the herein described embodiments as an image-bearing member results in the stabilization of the surface potential of the photoconductor 37, thereby suppressing the occurrence of image defects.

A resin used for the resin layer of the charging roller is not particularly limited as long as it can satisfactorily charge the circumferential face of the photoconductor 37. Specific examples of the resin used for the resin layer according to some embodiments include silicone resins, urethane resins, and silicone-modified resins. The resin layer may contain an inorganic filler.

The exposure portion 38 is what is called a laser scanning unit configured to irradiate the circumferential face of the photoconductor 37 uniformly charged by the charging portion 39 with laser light on the basis of image data input from a personal computer (PC) to form an electrostatic latent image on the photoconductor 37.

The developing portion 71 feeds a toner onto the circumferential face of the photoconductor 37 on which the electrostatic latent image has been formed, thereby forming a toner image on the basis of the image data. The resulting toner image is primarily transferred to the intermediate transfer belt 31.

The cleaning portion removes the remaining toner on the circumferential face of the photoconductor 37 after the primary transfer of the toner image to the intermediate transfer belt 31.

The charge eliminator eliminates the charge on the circumferential face of the photoconductor 37 after the completion of the primary transfer. The circumferential face of the photoconductor 37 that has been subjected to cleaning by the cleaning portion and neutralizing by the charge eliminator rotates to the charging portion for next charging treatment and is then subjected to another charging treatment in the charging portion.

The intermediate transfer belt 31 is an endless belt that is stretched over plural rollers, such as a driving roller 33, a driven roller 34, a backup roller 35, and primary transfer rollers 36, in such a manner that a surface (contact surface) of the intermediate transfer belt 31 is in contact with the circumferential face of each of the photoconductors 37.

The intermediate transfer belt 31 is configured to run endlessly over the plural rollers while the intermediate transfer belt 31 is pressed against the photoconductor 37 by the primary transfer rollers 36 that face the respective photoconductors 37.

The driving roller 33 is rotationally powered by a driving source, such as a stepping motor, and provides a driving force to cause the intermediate transfer belt 31 to run endlessly. The driven roller 34, the backup roller 35, and the primary transfer rollers 36 are rotatably arranged and are rotationally driven by the driving roller 33 via the endless run of the intermediate transfer belt 31. These rollers 34, 35, and 36 are rotationally driven by the rotation of the driving roller 33 via the intermediate transfer belt 31 and support the intermediate transfer belt 31.

The primary transfer rollers 36 apply a primary transfer bias (a polarity opposite to a charge polarity of toners) to the intermediate transfer belt 31. The toner images formed on the photoconductors 37 are sequentially transferred (primarily transferred) to the intermediate transfer belt 31 in a superposition manner at positions between the photoconductors 37 and the respective primary transfer rollers 36, the intermediate transfer belt 31 running in the direction indicated by the arrow (counterclockwise) by the driving of the driving roller 33.

The secondary transfer roller 32 applies a secondary transfer bias, which has a polarity opposite to that of the toner image, to the sheet P. The toner image primarily transferred to the intermediate transfer belt 31 is transferred to the sheet P at a position between the secondary transfer roller 32 and the backup roller 35, thereby transferring a color transfer image (unfused toner image) on the paper P.

The fusing portion 4 is configured for subjecting the transfer image transferred to the paper P in the image-forming portion 3 to fusing treatment. The fusing portion 4 includes a heating roller 41 heated by an electric heating member and a pressing roller 42 which faces the heating roller 41 and which has a circumferential face that is pressed against the circumferential face of the heating roller 41. The transfer image transferred to the paper P by the secondary transfer roller 32 in the image-forming portion 3 is subjected to fusing treatment by heating when the paper P is passed between the heating roller 41 and the pressing roller 42, thereby fusing the image on the paper P.

The fused paper P is ejected to the paper ejecting portion 5.

In the color printer 1 according to this illustrative embodiment, conveying rollers 6 are appropriately arranged between the fusing portion 4 and the paper ejecting portion 5.

The paper ejecting portion 5 is a recessed portion located on the top of the main body 1*a* of the color printer 1. A paper output tray 51 configured to receive the ejected paper P is arranged on the bottom of the recessed portion.

The color printer 1 forms an image on the paper P by the foregoing image-forming operations. Such a tandem-type image-forming apparatus described above includes the positive charging single-layer electrophotographic photoconductor according to the hereinabove embodiments as an image-bearing member. Accordingly, in some embodiments, the image-foaming apparatus is configured to suppress a rapid reduction in the surface potential of the positive charging single-layer electrophotographic photoconductor during initial use and forms a suitable image even under conditions in which a direct voltage is applied by the contact charging method, which charging method generally does not always provide satisfactory charging efficiency, i.e., the surface potential of the photoconductor is less likely to be stabilized (e.g., compared to non-contact charging).

EXAMPLES

While the present disclosure will be described in further detail below by examples, the present disclosure and the claimed subject matter are not limited to or by the examples.

Example 1

Metal-free phthalocyanine (5 parts by mass), a hole-transport material (HTM-1) of the following formula (50 parts by mass), an electron-transport material (ETM-1) of the following formula (35 parts by mass), dimethylpolysiloxane oil (trade name: KF-96-50cs, viscosity-average molecular weight: 3200, manufactured by Shin-Etsu Chemical Co., Ltd.) (0.01 parts by mass), a bisphenol Z-type polycarbonate resin with a viscosity-average molecular weight of 50,000 (100 parts by mass), and tetrahydrofuran (800 parts by mass) were charged into a ball mill. The mixture was subjected to dispersion treatment for 50 hours to prepare a coating liquid for a photosensitive layer. The resulting coating liquid was applied by dip coating onto a conductive base, which was a cylindrical aluminum tube having a diameter of 30 mm, and dried at 100° C. for 40 minutes to remove tetrahydrofuran from the coating film, thereby forming a positive charging single-layer electrophotographic photoconductor including a photosensitive layer that had a thickness of 30 μm:

(HTM-1)

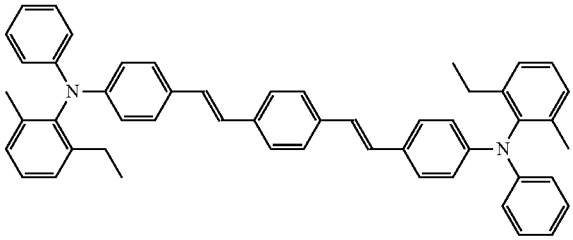

(ETM-1)

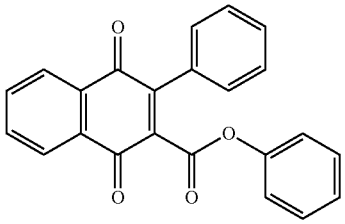

Examples 2 to 4 and Comparative Examples 1 to 4

Positive charging single-layer electrophotographic photoconductors were produced as in Example 1, except that the amounts of the dimethylpolysiloxane oil shown in Table 1 were used. Note that the amounts shown in Table 1 indicate percent by mass of the dimethylpolysiloxane oil contained in the photosensitive layer with respect to the total mass of the photosensitive layer.

Each of the positive charging single-layer electrophotographic photoconductors produced in these Examples and Comparative Examples was attached to a printer (Model: FS-05300DN, manufactured by KYOCERA MITA Corporation) including a charging roller that applied a direct voltage to a charging portion. The amount of a reduction in surface potential, which indicates the potential stability, and images were evaluated according to methods described below. Table 1 shows the evaluation results.

The difference in surface potential between the positive charging single-layer electrophotographic photoconductor at the start of endurance printing and the positive charging single-layer electrophotographic photoconductor after performing the endurance printing for 1 hour was measured to evaluate the reduction in the surface potential of the photosensitive layer with time during initial use.

After performing endurance printing for 1 hour, images formed by printing were observed to evaluate the presence or absence of the occurrence of an image defect. Evaluation criteria are described below.

Pass: No image defect was observed.

Failure: An image defect was observed.

Surfaces of the photosensitive layers of the positive charging single-layer electrophotographic photoconductors produced in the Examples and Comparative Examples were visually observed to evaluate the leveling property. Evaluation criteria are described below.

Pass: A crater was not formed on the surface of the photosensitive layer.

Failure: A crater was formed on the surface of the photosensitive layer.

TABLE 1

| | Amount of polysiloxane oil (% by mass) | Amount of reduction in surface potential (V) | Evaluation of an image | Evaluation of a leveling property |
|---|---|---|---|---|
| Example 1 | 0.005 | 89 | Pass | Pass |
| Example 2 | 0.0105 | 95 | Pass | Pass |
| Example 3 | 0.016 | 101 | Pass | Pass |
| Example 4 | 0.021 | 117 | Pass | Pass |
| Comparative Example 1 | 0 | 69 | Pass | Failure |
| Comparative Example 2 | 0.003 | 80 | Pass | Failure |
| Comparative Example 3 | 0.026 | 134 | Failure | Pass |
| Comparative Example 4 | 0.053 | 139 | Failure | Pass |

Figure 3:
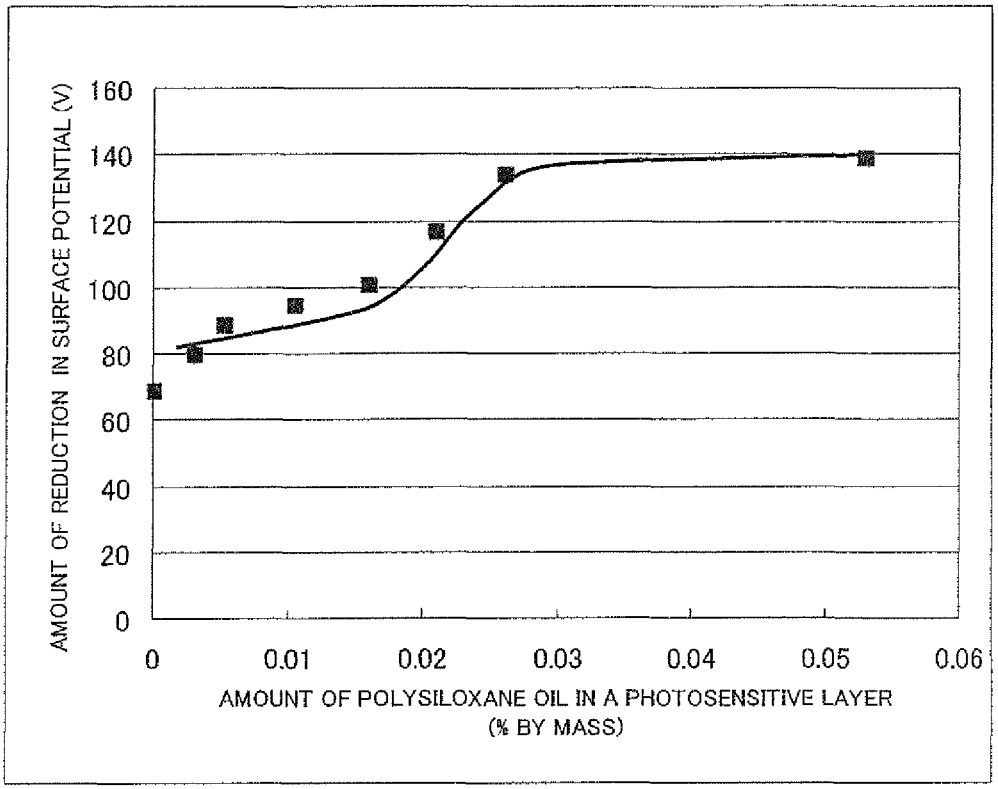
FIG. 3 is a graph illustrating the relationship between the polysiloxane oil amount of a photosensitive layer and the amount of reduction in surface potential in an experimental example according to some embodiments of the present disclosure.

FIG. 3 illustrates the relationship between the amount of polysiloxane oil in the photosensitive layer and the amount of the reduction in the surface potential of the positive charging single-layer electrophotographic photoconductor after performing the endurance printing for 1 hour from the results of the Examples and Comparative Examples.

FIG. 3 demonstrates that a polysiloxane oil amount of the photosensitive layer of 0.021% by mass or less results in the suppression of the reduction in the surface potential of the positive charging single-layer electrophotographic photoconductor after performing the endurance printing for 1 hour.

The results demonstrate that a polysiloxane oil amount of the photosensitive layer of 0.016% by mass or less results in further suppression of the reduction in the surface potential of the positive charging single-layer electrophotographic photoconductor after performing the endurance printing for 1 hour.

In the positive charging single-layer electrophotographic photoconductor produced in each of Examples 1 to 4 in which the polysiloxane oil amount of each photosensitive layer is in the range of about 0.005% by mass to about 0.021% by mass with respect to the total mass of the materials in the photosensitive layer, good leveling property is obtained, and the reduction in surface potential after performing the endurance printing for 1 hour is small and stable, so that an image defect is less likely to occur.

In the positive charging single-layer electrophotographic photoconductor produced in each of Comparative Examples 1 and 2 in which the polysiloxane oil amount of each photosensitive layer is less than 0.005% by mass with respect to the total mass of the materials, the reduction in surface potential after performing the endurance printing for 1 hour is small and stable, so that an image defect is less likely to occur. However, the leveling property is poor because the crater is formed on the surface of the photosensitive layer.

In the positive charging single-layer electrophotographic photoconductor produced in each of Comparative Examples 3 and 4 in which the polysiloxane oil amount of each photosensitive layer exceeds 0.021% by mass with respect to the total mass of the materials, good leveling property is obtained. However, a significant reduction in the surface potential of the positive charging single-layer electrophotographic photoconductor after performing the endurance printing for 1 hour is observed, and image defects, such as a fog on the background and nonuniformity of a gray image, occurred.

Having thus described in detail embodiments of the present disclosure, it is to be understood that the subject matter disclosed by the foregoing paragraphs is not to be limited to particular details and/or embodiments set forth in the above description, as many apparent variations thereof are possible without departing from the spirit or scope of the present disclosure.

What is claimed is:

1. A positive charging single-layer electrophotographic photoconductor configured to serve as an image-bearing member for use in an image-forming apparatus, comprising:

a photosensitive layer on a conductive base, the photosensitive layer including a charge-generating material, a hole-transport material, an electron-transport material, and a binder resin, wherein the photosensitive layer includes a polysiloxane oil; and wherein the polysiloxane oil is a dimethylpolysiloxane oil in an amount at least about 0.005% by mass and not greater than about 0.021% by mass with respect to the total mass of materials.

2. The positive charging single-layer electrophotographic photoconductor according to claim 1, wherein the amount of dimethylpolysiloxane oil is at least 0.005% by mass and not greater than 0.0105% by mass with respect to the total mass of materials in the photosensitive layer.

3. The positive charging single-layer electrophotographic photoconductor according to claim 1, wherein the dimethylpolysiloxane oil has a viscosity-average molecular weight of 1,000 to 10,000.

4. The positive charging single-layer electrophotographic photoconductor according to claim 1, wherein the charge-generating material is metal-free phthalocyanine.

5. The positive charging single-layer electrophotographic photoconductor according to claim 1, further comprising:

an intermediate layer provided between the conductive base and the photosensitive layer.

6. The positive charging single-layer electrophotographic photoconductor according to claim 1, further comprising:

a protective layer provided on the photosensitive layer.

7. An image-forming apparatus comprising:

an image-bearing member;

a charging portion configured to charge a surface of the image-bearing member;

an exposure portion configured to expose the charged image-bearing member to form an electrostatic latent image on the surface of the image-bearing member;

a developing portion configured to develop the electrostatic latent image to form a toner image; and a transfer portion configured to transfer the toner image from the image-bearing member to an object, wherein the image-bearing member comprises the positive charging single-layer electrophotographic photoconductor according to claim 1.

8. The image-forming apparatus according to claim 7, wherein the charging portion is configured to apply a direct voltage by a contact charging method.

9. The image-forming apparatus according to claim 7, wherein the charging portion includes a charging roller configured to come into contact with the surface of the positive charging single-layer electrophotographic photoconductor to charge the photosensitive layer.

10. The image-forming apparatus according to claim 9, wherein the charging roller includes a resin layer comprising a resin, wherein the resin contains at least one of silicone resins, urethane resins, and silicone-modified resins.

11. A method for forming an image, comprising:

charging a surface of a image-bearing member;

exposing the charged image-bearing member to form an electrostatic latent image on the surface of the image-bearing member;

developing the electrostatic latent image to form a toner image; and transferring the toner image from the image-bearing member to an object, wherein the image-bearing member comprises the positive charging single-layer electrophotographic photoconductor according to claim 1.

12. A method for forming an image according to claim 11, wherein in the charging of the surface of the image-bearing member, the surface of the image-bearing member is applied by a direct voltage with a contact charging method.

13. The method for forming an image according to claim 11, wherein in the charging of the surface of the image-bearing member, a charging roller charges the surface of the image-bearing member by a contact charging method.

* * * * *